US009156255B2

(12) United States Patent
Gengrinovich et al.

(10) Patent No.: US 9,156,255 B2
(45) Date of Patent: Oct. 13, 2015

(54) MOVEMENT OF FLUID WITHIN PRINTHEAD CHANNELS

(75) Inventors: Semion Gengrinovich, Fort Collins, CO (US); Dennis Indorsky, Netanya (IL); Ran Vilk, Netanya (IL); Lev Superfin, Netanya (IL)

(73) Assignee: Hewlett-Packard Industrial Printing LTD., Netanya (IL)

( * ) Notice: Subject to any disclaimer, the term of this patent is extended or adjusted under 35 U.S.C. 154(b) by 0 days.

(21) Appl. No.: 14/365,735

(22) PCT Filed: Dec. 22, 2011

(86) PCT No.: PCT/IL2011/000962

§ 371 (c)(1),
(2), (4) Date: Jun. 16, 2014

(87) PCT Pub. No.: WO2013/093901

PCT Pub. Date: Jun. 27, 2013

(65) Prior Publication Data

US 2015/0035884 A1 Feb. 5, 2015

(51) Int. Cl.
*B41J 29/393* (2006.01)
*B41J 2/045* (2006.01)

(52) U.S. Cl.
CPC ..... *B41J 2/04588* (2013.01); *B41J 2/04581* (2013.01); *B41J 2/04596* (2013.01)

(58) Field of Classification Search
CPC ..... B41J 29/3935; B41J 2/125; B41J 2/0451; B41J 2/2142; B41J 11/0095; B41J 2/2146; B41J 2/01; B41J 2/04505
See application file for complete search history.

(56) References Cited

U.S. PATENT DOCUMENTS

| | | | |
|---|---|---|---|
| 4,161,670 | A | 7/1979 | Kern |
| 5,402,159 | A | 3/1995 | Takahashi |
| 5,850,240 | A | 12/1998 | Kubatzki |
| 6,707,231 | B2 | 3/2004 | Pease |
| 8,035,854 | B2 | 10/2011 | Watanabe |

(Continued)

FOREIGN PATENT DOCUMENTS

| | | |
|---|---|---|
| CN | 101137508 A | 3/2008 |
| EP | 0788882 | 8/1997 |
| EP | 1024000 | 8/2000 |

OTHER PUBLICATIONS

W. H. M. Zijm, Structure- and fluid-dynamics in piezo inkjet printheads,PROEFSCHRIFT, 185pp, Jan. 25, 2008.

(Continued)

*Primary Examiner* — Lamson Nguyen
(74) *Attorney, Agent, or Firm* — Hewlett-Packard Patent Department

(57) ABSTRACT

In one embodiment, an actuator connected to a printhead structure is activated with a waveform to cause vibration of the structure sufficient to move fluid within a printhead channel adjacent to the structure and not cause the fluid to eject from the channel during a nonprinting period. In another embodiment, a first pulse module applies a pulse at a printhead structure at a combination of voltage, duration, and frequency to cause shaking of printhead structure to move fluid within a printhead channel adjacent to the structure without ejecting the fluid from the channel during a nonprinting period. In another embodiment, an actuator connected to a printhead structure is activated during a nonprinting period to pulse the structure to move fluid within a printhead channel adjacent to the structure without causing the fluid to be expelled from the channel.

15 Claims, 9 Drawing Sheets

(56) References Cited

U.S. PATENT DOCUMENTS

| | | | |
|---|---|---|---|
| 2003/0122885 | A1 | 7/2003 | Kobayashi |
| 2004/0001123 | A1 | 1/2004 | Yamaguchi |
| 2009/0167815 | A1 | 7/2009 | Ito |
| 2010/0030230 | A1 | 2/2010 | Havel et al. |
| 2010/0039463 | A1 | 2/2010 | Van Thillo |
| 2010/0180866 | A1 | 7/2010 | Becker |
| 2011/0007318 | A1 | 1/2011 | Okuda |
| 2011/0105805 | A1 | 5/2011 | Buchanan et al. |
| 2011/0298872 | A1 | 12/2011 | Hayashi |

OTHER PUBLICATIONS

International Search Report and Written Opinion received in PCT Application No. PCT/IL2011/000962, mailed Aug. 14, 2012, 11 pages.

Chinese Office Action dated May 19, 2015, with machine english translation. p. 6 of 7 lists Chinese reference cited above as "A" (Background).

MOVEMENT OF FLUID WITHIN PRINTHEAD CHANNELS

BACKGROUND

Image printing may be accomplished by providing relative movement between a printhead and a print substrate while both the printhead and the substrate are travelling in one or two orthogonal directions. The printhead ejects droplets of ink onto the print substrate to form an image. Typically, a colored ink is deposited on a white substrate.

Recently, however, there is an increase in use of clear or transparent and colored substrates. In order to alleviate the influence of the substrate color upon the printed image and improve faithful color reproduction, a white ink may be applied on the color or transparent substrate to provide an opaque background. For example, a printer may print a white ink background over an entire substrate, or a segment of the substrate, before printing the image. In another example, where there is a transparent substrate or a backlit display a printer may print white ink over the image after the image is printed such that the image can be viewed through the substrate from the non-printed side.

BRIEF DESCRIPTION OF THE DRAWINGS

The accompanying drawings illustrate various embodiments and are a part of the specification. The illustrated embodiments are examples and do not limit the scope of the claims. Throughout the drawings, identical reference numbers designate similar, but not necessarily identical elements.

The same part numbers designate the same or similar parts throughout the figures.

DETAILED DESCRIPTION OF EMBODIMENTS

A printer configured with white ink can print onto a range of substrates not achievable with standard printing systems. However, the specific weight of certain white pigment particles used in a white ink formulation, e.g., titanium dioxide, can be three to four time larger than the specific weight of other color pigments. Because of this, the white pigment particles tend to precipitate or sediment rapidly in the white ink. The precipitated pigment particles form precipitates or sediments that introduce disturbances in printhead operation. Such precipitation or sedimentation is particularly pronounced during printhead idle times. The disturbances may be such that an irreversible damage to the printhead can occur.

Figure 1:
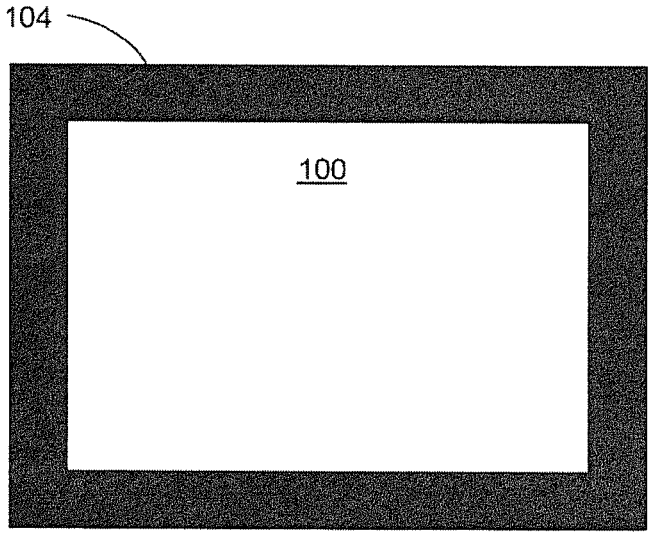
FIG. 1 provides an example of a white pattern printed using a printhead ejecting white ink upon a black substrate.

FIG. 1 is an example of a white pattern 100 printed with an inkjet printer with white ink on a black substrate 104. Pattern 100 is smooth and does not exhibit artifacts of the black substrate. It serves as background on which a color image could be printed. In an example of inkjet printing, white pattern 100 may be printed, and then a second pattern, e.g., a color pattern, deposited upon pattern 100. In another example, the white pattern 100 is applied as an overcoat following color image printing.

Figure 2:
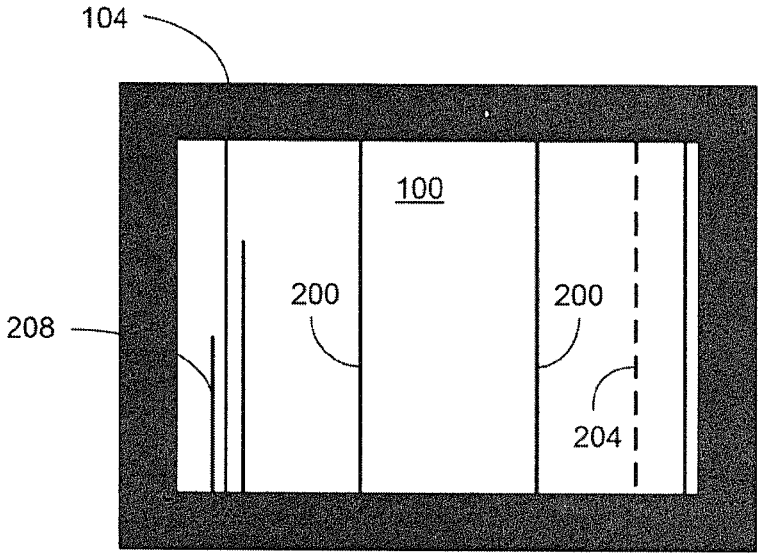
FIGS. 2-4 provide examples of white patterns printed using printheads ejecting white ink upon black substrates after various printhead idle times.
Figure 3:
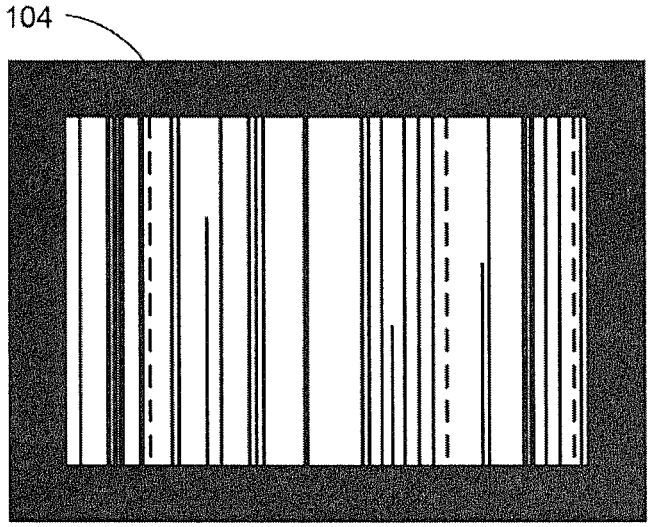
Figure 4:
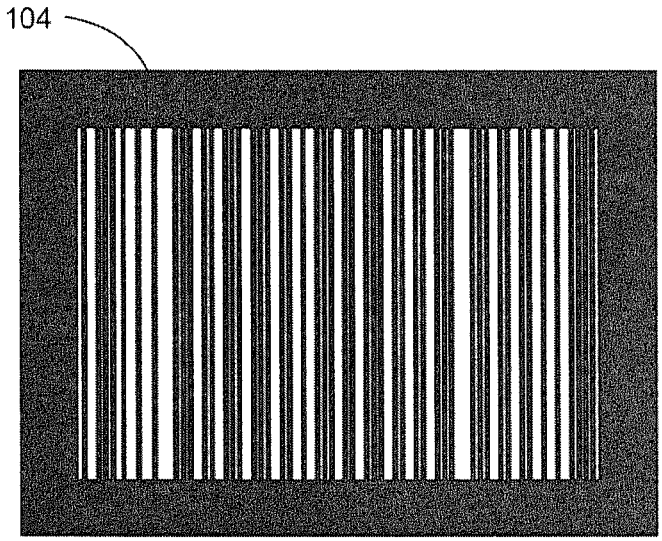

FIG. 2 is an example of the same white pattern 100 printed on a black background 104 with the same printhead as was used to produce the example of FIG. 1, after fifteen minutes of the printhead idle time. The presence of strips 200 in the example of FIG. 2 shows that some of the printhead nozzles are completely clogged. Strips 200 are strips of exposed black substrate where failed nozzles are not operative. Nozzle failures can create patterns other than strips 200. For example, some of the nozzles may be partially clogged depositing incomplete white lines 204, or otherwise fail in the process of printing to expose segments 208 of the substrate. FIG. 3 is an example of the same white pattern 100 printed on a black substrate 104 after fifty minutes of the printhead idle time. FIG. 4 is an example of the same white pattern printed on a black substrate 104 after two hundred-forty minutes if printhead idle time. The number of strips, incomplete white lines, and exposed segments of substrate increase as printhead idle time increases.

Figure 5:
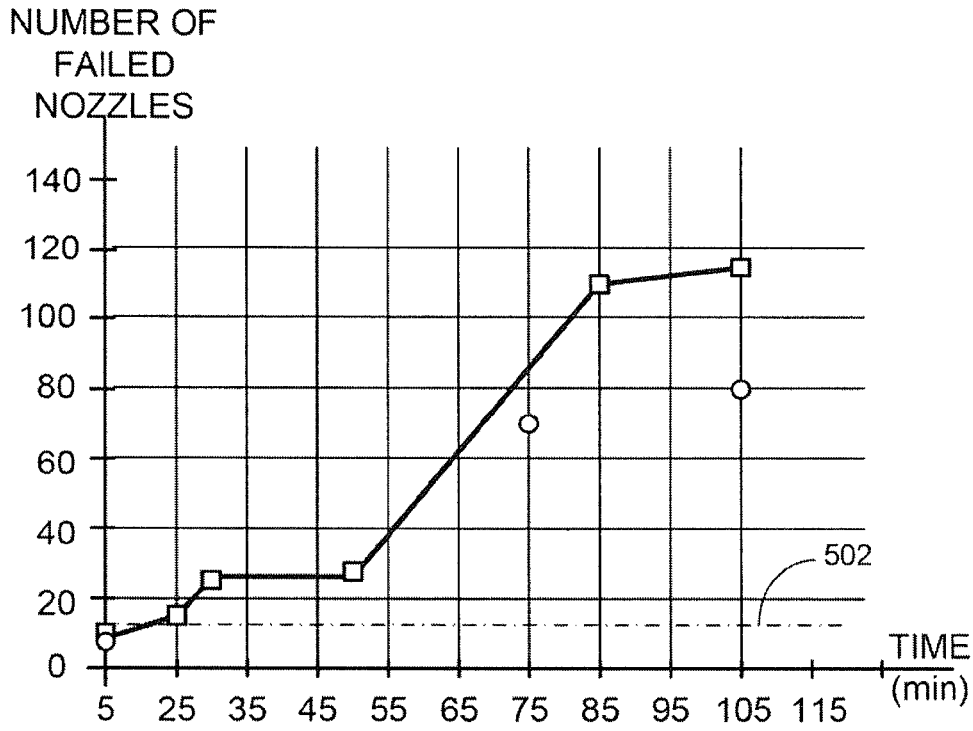
FIG. 5 is an example graph showing a change in the number of failed nozzles as a function of idle time for a printhead.
Figure 6:
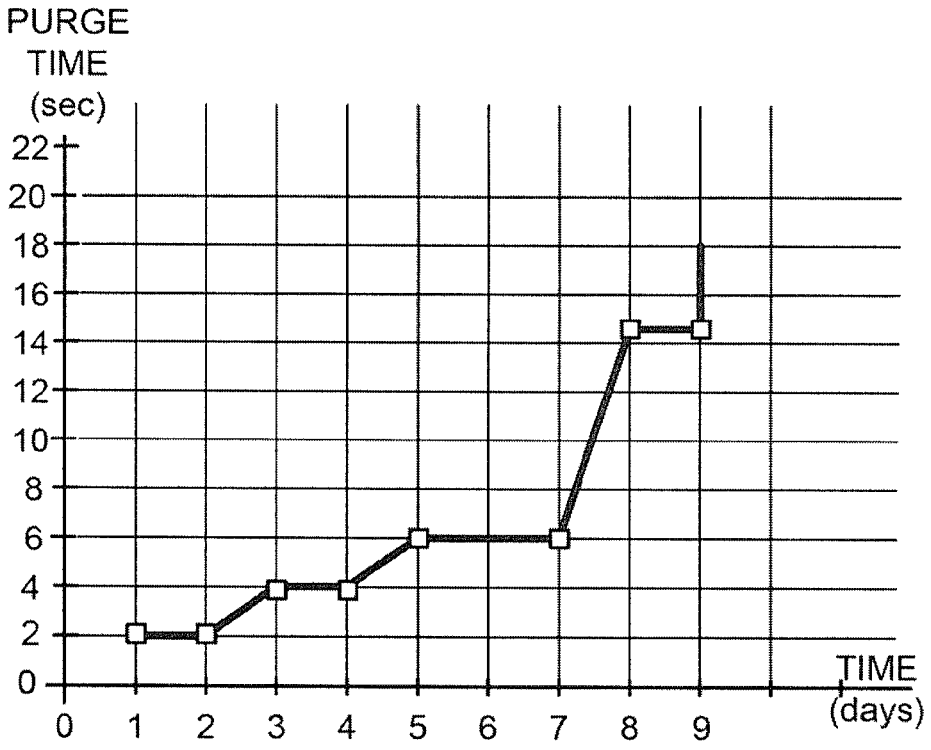
FIG. 6 is an example graph showing purging time needed to recover failed nozzles in a printhead when printing with white ink.

FIG. 5 is a graph showing change in number of failed nozzles as a function of idle time for a printer printhead printing with white ink. It is evident that at about twelve to fifteen minutes of idle time this printhead crosses a threshold 502 of approximately fifteen nozzles out that is determined to be unacceptable for operation of a printhead printing with white ink in this example. The graph reveals that the number of failed nozzles grows fast after about fifty minutes of idle time, at which point massive nozzles failure begins. These printhead failures will in many cases be recoverable with the performance of proper printhead maintenance procedures, e.g. printhead purging. FIG. 6 is a graph showing effect of purging time for a printhead printing with white ink on failed nozzles recovery. FIG. 6 shows that the amount of purging time needed for printhead recovery increases as printhead idle time increases. In this example, after about nine days of idle time, and despite regular application of purging procedure, the printhead exhibits a non-recoverable failure.

Different white ink mixing and steering methods exist for preventing or discouraging ink precipitation or sedimentation by agitating ink in a tank or in an ink guide that delivers ink to printheads. However, such methods do not address the issues of ink pigment particle precipitating in the printhead, and in particular in ink channels conducting the ink to the orifices through which the ink is ejected. Accordingly, various embodiments described herein were developed to provide a system, a method, and a computer-readable storage medium containing instructions, to enable printing with white ink and other fluids that are prone to precipitation and/or sedimentation issues at the printhead and the printhead channels. According to various embodiments, an actuator connected to a printhead structure is activated with a waveform or pulse during a nonprinting period to cause vibration of the structure sufficient to move fluid within a printhead channel adjacent to the structure, and yet not cause the fluid to eject from the channel. The movement of the fluid in the printhead channels prevents white pigment precipitation and/or sedimentation and drying out on the nozzle plate and around the nozzles. The activation of the actuator takes place during at a nonprinting period, which may include, but is not limited to, a substrate loading or unlading period, and/or a printhead deceleration period.

In certain embodiments, the printhead is a printer printhead for applying to ink to a substrate, the actuator is a piezoelectric actuator, the fluid includes pigment particles, and the movement of the fluid in the channel is sufficient to prevent precipitation or sedimentation of the particles within the printhead. Advantages of the disclosure include the enablement of printing with white ink and other fluids prone to precipitation or sedimentation with fewer interruptions. Another advantage that this disclosure can be implemented to move the fluid within the printhead channels without a requirement of adding additional parts or materials to the printhead. The disclosed embodiments are likely to lead to a better user experience when printing with white inks and other fluids prone to rapid precipitation or sedimentation in the printhead, resulting in increased usage of such printers and inks.

It should be noted that while the disclosure is discussed frequently with reference to white ink, white pigment, and printers, the teachings of the present disclosure are not so limited and may be applied to ejection of inks other than white ink for printing. The teachings of the present disclosure may also be applied to ejection of fluids other than inks, including ejection of fluids for purposes unrelated to printing. The present disclosure thus can be applied to ejection of any fluid prone to precipitation or sedimentation. Examples of ejection of precipitation-prone or sedimentation-prone fluids for purposes other than printing include the dispensing of certain medicines, fuels, juices and other fluids.

As used herein, a "printer" or "printing device" refers to any electronic device that prints and includes multifunctional electronic devices that perform additional functions such as scanning and/or copying. A "printhead" refers to a mechanism having a plurality of nozzles through which ink or other fluid is ejected. Examples of printheads are drop on demand inkjet printheads, such as piezoelectric printheads and thermo resistive printheads. Some printheads may be part of a cartridge which also stores the fluid to be dispensed. Other printheads are standalone and are supplied with fluid by an off-axis ink supply. "Ink" refers to any fluid used for printing including but not limited to aqueous inks, solvent inks, UV-curable inks, dye sublimation inks and latex inks. "Pigment" refers to a coloring matter, including, but not limited to insoluble powders, to be mixed with water, oil, or another base to produce an ink or other fluid. "Actuator" refers to a device that converts input electrical energy or current into output energy of in the form of an acoustic wave that activates (e.g., by vibrating, shaking or deforming) a printhead structure. A "piezoelectric actuator" refers to an actuator that includes piezoelectric material that mechanically deforms when an external electric field or current is applied to the material. "Waveform" refers to a pattern of voltage fluctuation. "Pulse" refers to a change in voltage or in current intensity. A "printing period" for a printhead refers to a period during which the printhead is being utilized to dispense fluid in response to a request for fluid dispensing (including, but not limited to print requests). A "nonprinting period" or "idle time" for a printhead refers to a period during which the printhead is not being utilized to dispense fluid in response to a request for fluid dispensing. A "substrate loading or unloading period" refers to period during which a substrate is being loaded at printer into a print zone, and may include a period that the substrate is prepared for printing (e.g., a heating of the substrate) or recovers from printing (e.g., cooling) while in the print zone. A "printhead deceleration period" refers to a period in which a printhead recovers (e.g., in terms of temperature) from an operational to a resting state after having been utilized to meet a specific service request.

Figure 7:
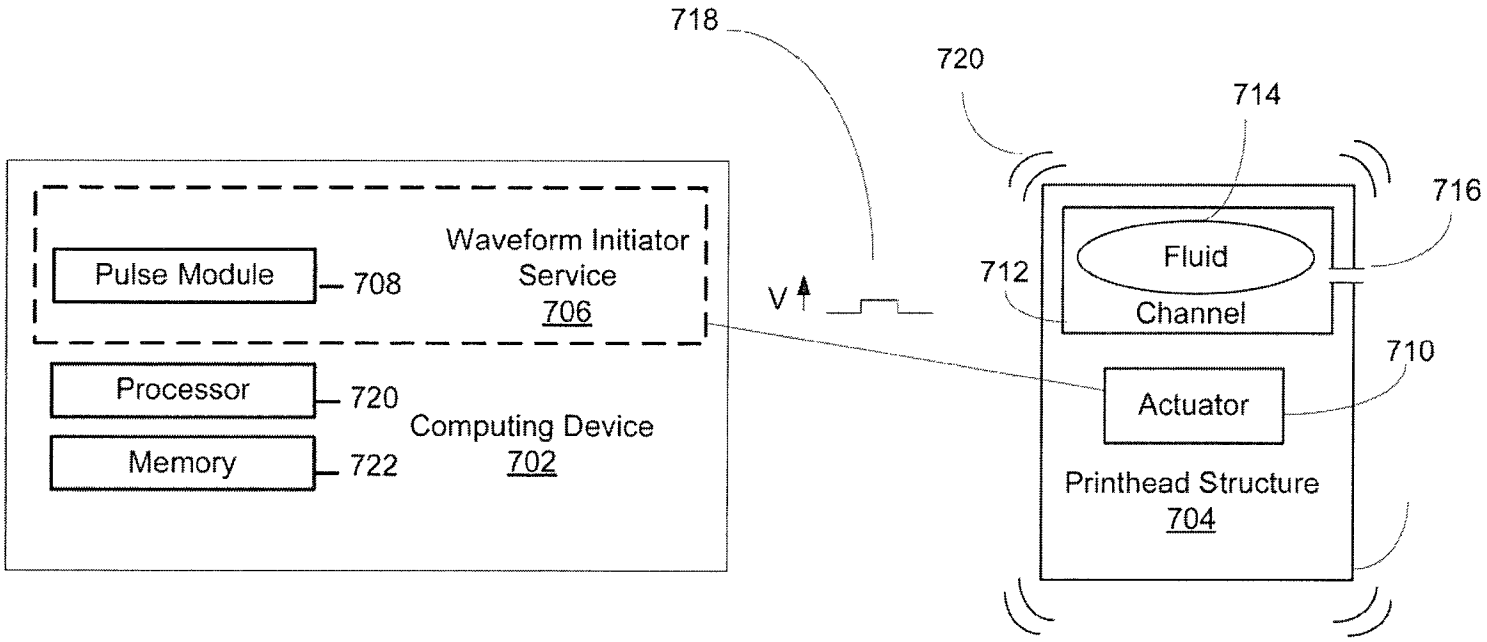
FIG. 7 is a block diagram illustrating a system according to various embodiments.

FIG. 7 is a block diagram illustrating a system according to various embodiments. FIG. 7 includes particular components, modules, etc. according to various embodiments. However, in different embodiments, more, fewer, and/or other components, modules, arrangements of components/modules, etc. may be used according to the teachings described herein. In addition, various components, modules, etc. described herein may be implemented as one or more software modules, hardware modules, special purpose hardware (e.g., application specific hardware, application specific integrated circuits (ASICs), embedded controllers, hardwired circuitry, etc.), or some combination of these.

FIG. 7 shows a computing device 702 electronically connected to printhead structure 704. Computing device 702 represents generally any computing device or group of computing devices configured to execute a waveform initiator service 706 and cause the sending of an electronic waveform or pulse with defined specifications to a printhead structure 704 to cause movement of the fluid within a printhead channel. In an embodiment, computing device 702 is a controller or other computer or group of computers included within a printing device, e.g., an inkjet printer that includes printhead structure 704. In another embodiment, computing device 702 is a computer or computer system that is electronically connected to a printhead. In embodiments, computing device 702 may be or include a server, desktop computer, notebook computer, mobile device, tablet computer, and/or any other computing device electronically connected to a printhead.

Printhead structure 704 represents generally any printhead. As previously noted, printhead 704 may be a piezoelectric printhead, thermo resistive printhead, or other printhead configured to eject a fluid upon a substrate during printing operations. In other embodiments, printhead 704 may be a piezoelectric printhead, thermo resistive printhead, or other printhead configured to eject inks other than white ink for printing. In other embodiments, printhead 704 may be a piezoelectric printhead, thermo resistive printhead, or other printhead configured to eject fluids other than inks for purposes unrelated to printing, e.g., to medicines, fuels, juices and other fluids.

Printhead structure 704 includes a channel 712, to hold fluid to be expelled from the channel during a printing event. Printhead structure 704 also includes an actuator 710 to cause the printhead structure 704 to vibrate or shake. During a printing event, vibration or shaking is induced at a level that causes expulsion of the fluid from channel 712 through a nozzle 716 that is connected to, or a part of, channel 712. In an embodiment, the fluid is an ink (e. a white ink) and is expelled to create a printed image on a substrate.

Computing device 702 is shown to include a waveform initiator service 706, a processor 720, and a memory 722. Waveform initiator service 706 represents generally any combination of hardware and programming configured to cause movement of fluid within a printhead channel during a nonprinting period and thereby prevent precipitation or sedimentation of particles within the fluid.

In this example, waveform initiator service 706 includes a pulse module 708. Pulse module 708 activates actuator 710 connected to printhead structure 704 by applying a voltage waveform or pulse 718. The waveform or pulse 718 causes vibration 720 of the structure sufficient to move fluid 714 within printhead channel 712 adjacent to the structure 704, and yet does not cause the fluid 714 to eject from channel 712 during the nonprinting period.

The functions and operations described with respect to waveform initiator service 706 and computing device 702 may be implemented as a computer-readable storage medium containing instructions executed by a processor (e.g., processor 720) and stored in a memory (e.g., memory 722). In a given implementation, processor 720 may represent multiple processors, and memory 722 may represent multiple memories. Processor 720 represents generally any instruction execution system, such as a computer/processor based system or an ASIC (Application Specific Integrated Circuit), a computer, or other system that can fetch or obtain instructions or logic stored in memory 722 and execute the instructions or logic contained therein. Memory 722 represents generally any memory configured to store program instructions and other data.

Figure 8:
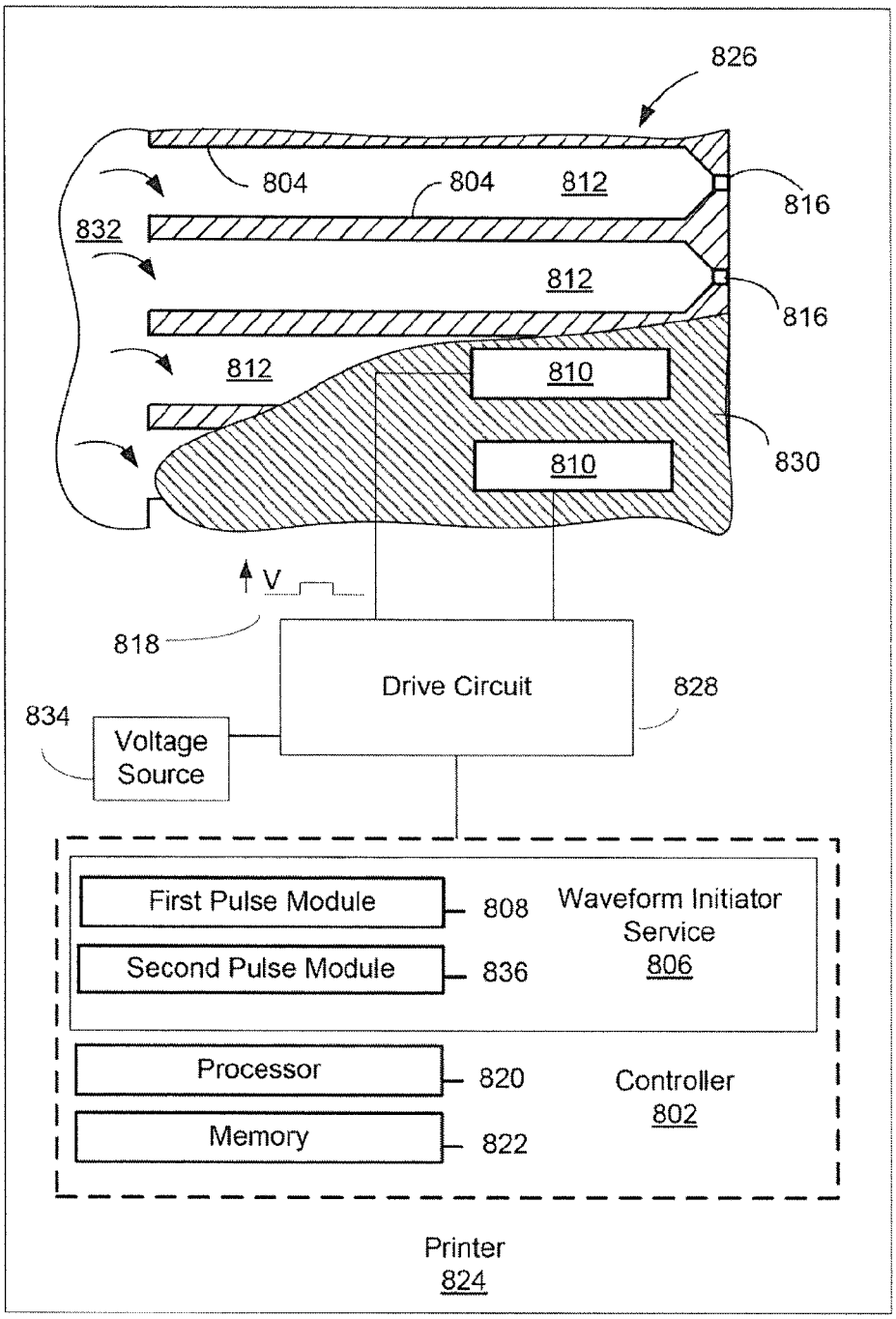
FIG. 8 is a diagram illustrating a system, including a waveform initiator and a piezo printhead, according to various embodiments.

FIG. 8 is a diagram illustrating a system according to various embodiments. FIG. 8 includes particular components, modules, etc. according to various embodiments. However, in different embodiments, more, fewer, and/or other components, modules, arrangements of components/modules, etc. may be used according to the teachings described herein. In addition, various components, modules, etc. described herein may be implemented as one or more software modules, hardware modules, special purpose hardware (e.g., application specific hardware, application specific integrated circuits (ASICs), embedded controllers, hardwired circuitry, etc.), or some combination of these.

FIG. 8 shows a printer 824, representing generally any computing device that is operable to produce printed content. In some embodiments, printer 824 is a multifunctional electronic device that performs additional functions such as scanning and/or copying. Printer 824 includes a piezoelectric printhead 826, drive circuit 828, and controller 802.

In this example, piezoelectric printhead 826 represents generally a drop on demand printhead for expelling a precipitation-prone or sedimentation-prone fluid (e.g. a white ink including titanium dioxide) upon a substrate. In this example, printhead 826 includes a micro-machined silicon chip structure 804 that is adjacent to, and forms the walls of, fluid channels 812. Fluid channels 812 extend from fluid supply reservoir 832 and terminated by fluid-ejecting nozzles 816. In other embodiments, the channels 812 may be adjacent to the printhead structure but not formed by the printhead structure. The width of channel 812 is such that ample and stable fluid flow can be provided through channel 812 to nozzle 816 during printing operations. In examples, the width of channel 704 may vary from 300 microns to 600 microns. In the example of FIG. 8, a printhead structure includes a diaphragm or glass plate 830 that is bonded to the silicon chip portion 804 of the structure and overlays the channels 812. Associated with each channel 812 is a piezoelectric actuator 810, which when selectively actuated, vibrates, shakes bends, and/or deforms a respective section of the glass plate 830 portion of the printhead structure 804 to pressurize fluid in the channel 812.

Drive circuit 828 represents generally a circuit arrangement for activating actuators 810. Voltage is applied to the drive circuit 828 via a voltage source 834. Drive circuit 828 is electronically connected to actuators 810. In an embodiment, the electronic connection between drive circuit 828 and actuators 810 includes electrodes embedded in actuators 810. In examples, the voltage may be a DC voltage from a battery or other DC voltage source. In other examples, the voltage may be AC voltage from an AC voltage source.

Controller 802 represents generally any computing device or group of computing devices internal to printer 824 that controls printing and other operations performed by printer 824. Controller 802 includes a Waveform Initiator Service 806, a processor 820 and a memory 822, and is electronically connected to drive circuit 828.

Waveform initiator service 806 represents generally any combination of hardware and programming configured to cause the sending of an electronic waveform or pulse 818 with defined specifications to an actuator. The waveform or pulse causes a vibration, shaking, bending or deformation of the printhead structure to cause movement of fluid within a printhead channel during a nonprinting period. This prevents or discourages precipitation or sedimentation of particles within the fluid. In this example, waveform initiator service 806 includes a first pulse module 808 and a second pulse module 836.

Figures 9A, 9B, 9C:
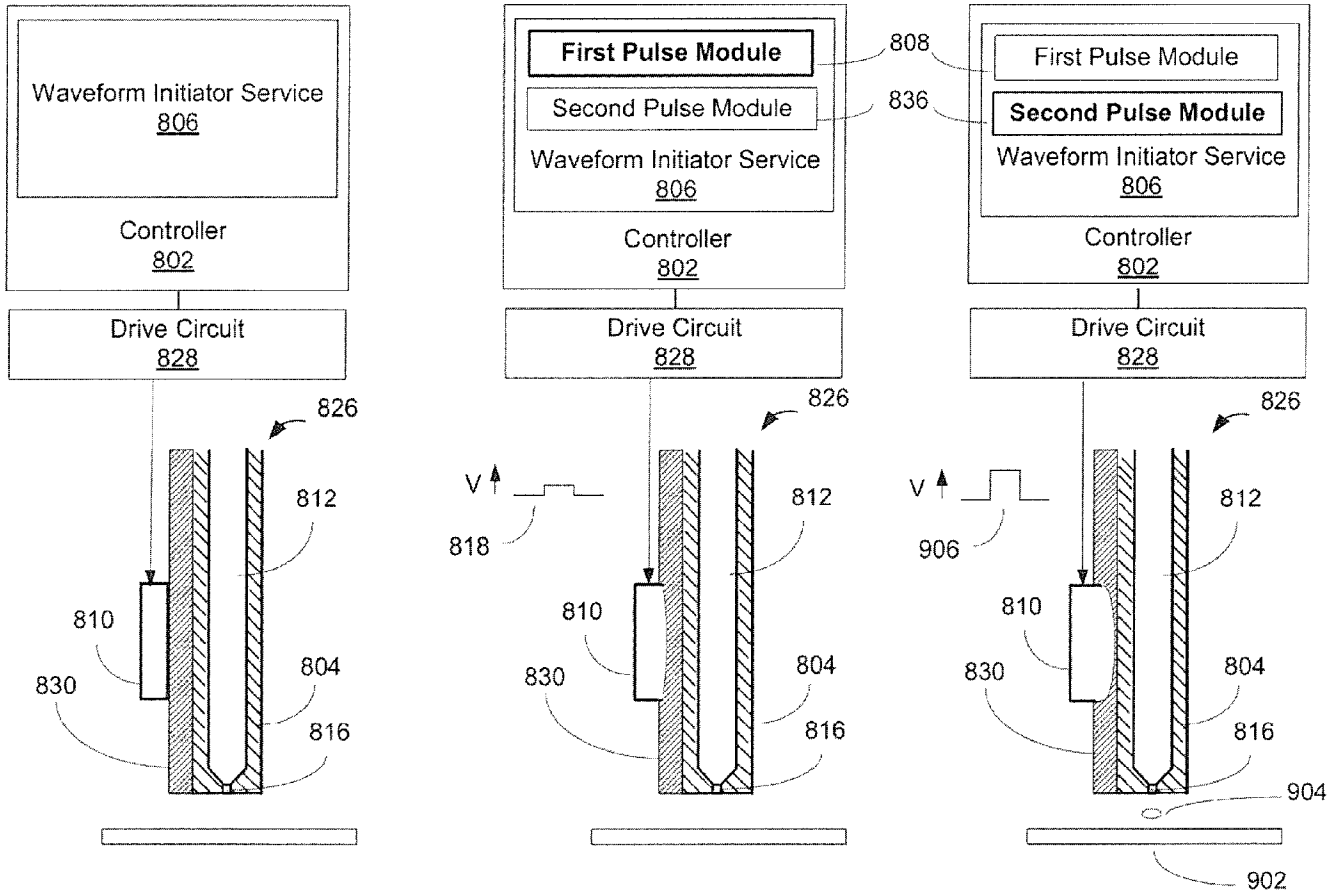
FIGS. 9A, 9B, and 9C are diagrams illustrating effects from application of a waveforms or pulses upon a piezo printhead, according to various embodiments.

In an example, FIG. 9A illustrates the system of FIG. 8 during a nonprinting period in which no voltage is applied to piezoelectric actuator 810, and therefore there is no pulsing or vibrating of the chip 804 printhead structure 804 or the glass printhead structure 808. Without application of a voltage to actuator 810 during such period, certain fluids, such as an ink containing titanium dioxide, are prone to precipitation or sedimentation in channel 812.

FIG. 9B illustrates the system of FIG. 8 during a nonprinting period (which may include, but is not limited to, a substrate loading or unloading period, and/or or a printhead deceleration time). First pulse module 808 of waveform initiator service 806 causes the first voltage to be applied through drive circuit 828 to piezoelectric actuator 810 to activate piezoelectric actuator 810 with a voltage waveform or pulse of a combination of voltage, frequency, and duration to cause a vibration, shaking, bending, or deformation of the structure. The vibration, shaking, bending or deformation is sufficient to move fluid within channel 812, but not so great as to cause an ejection or expulsion of the fluid from the channel during a nonprinting period. The movement of the fluid in the channel causes a mixing of fluid that prevents or discourages precipitation or sedimentation of particles from the fluid. In embodiments, the pulse is applied at intervals sufficient to discourage precipitation or sedimentation of particles from the fluid.

FIG. 9C illustrates the system of FIG. 8 during a printing period in which piezoelectric printhead 826 is utilized to dispense fluid upon a substrate 902 in response to print request. The request is a request for printer 824 to print an image upon substrate 902. In an example the print request is received at printer 824 from a user via a user interface at printer 824. In another example, the request is received at printer 824 from another computing device that is electronically connected to printer 824. Second pulse module 836 causes a second voltage to be applied through drive circuit 828 to piezoelectric actuator 810 to activate piezoelectric actuator 810 with a waveform or pulse. The waveform or pulse expands the piezoelectric actuator 810 sufficiently to sufficient to cause a sufficient vibration, bending, or deformation of the glass plate 830 portion of printhead structure and/o the chip portion 804 of printhead structure to cause an ejection or expulsion 904 of the fluid from channel 812, through nozzle 816 and onto substrate 902. Each ejected drop of fluid is replaced by a flow of fluid from fluid reservoir 832 (FIG. 8). In examples, the waveform or pulse 906 applied to a piezoelectric actuator 810 during a printing operation has a second voltage within a range of 36 to 42 volts, an operating frequency with a range of 8 to 12 MHz, and a pulse duration within a range of 8-16 microseconds.

Returning to FIG. 9B, in embodiments, various waveforms or pulses 818 activate actuator 810 during nonprinting periods to cause vibration of printhead structure sufficient to move fluid within, but not cause fluid ejection from, channel 812 (for purposes of FIG. 9B, a "tickle activation). In one embodiment, tickle activation of the actuator 810 occurs utilizing a substantially same voltage and a substantially same frequency as are used when actuator 810 is activated to expel fluid from channel 812 during a printing operation (as illustrated in FIG. 9C). In this embodiment, the tickle activation is for a first duration that is less the second duration that actuator 810 is activated during a printing operation. In an embodiment, the first duration is between substantially thirty percent and thirty-five percent of the second duration.

Continuing with FIG. 9B, in another embodiment, tickle activation of actuator 810 is at a first voltage that is less than the second voltage used when actuator 810 is used to expel fluid from channel 812 during a printing operation, at a first frequency that is less than a second frequency used when actuator 810 is used to expel fluid from channel 812 during the printing operation, and for a first duration that is less than second duration actuator 810 is activated during a printing operation. In an embodiment, the first voltage is between substantially twenty-five percent and thirty-three percent of the second voltage. In an embodiment, the first frequency is between substantially ten percent and twelve percent of the second frequency. In embodiment, the first duration is between substantially thirty percent and thirty-five percent of the second duration.

Continuing with FIG. 9B, in another embodiment, tickle activation of actuator 810 is at about the same operating voltage and frequency as during a printing operation, but for a shorter pulse duration time, for example, two to four microseconds. Such short drive pulse time does not cause ink drop ejection.

Continuing with FIG. 9B, in another embodiment tickle activation of activator 810 is at a voltage of substantially 8 V to 10 V, a frequency of substantially 2 KHz to 4 KHz, and for duration of substantially 2 to 4 microseconds.

Figure 10:
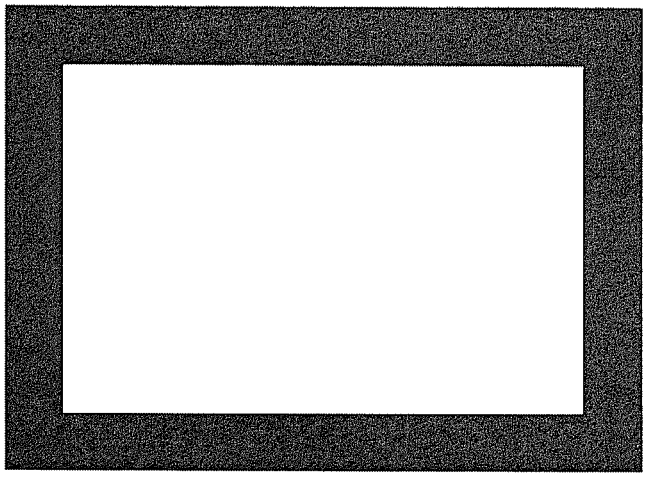
FIGS. 10-11 provide examples of white patterns printed upon black substrate with movement of white ink within printhead channels during the idle times, according to various embodiments.
Figure 11:
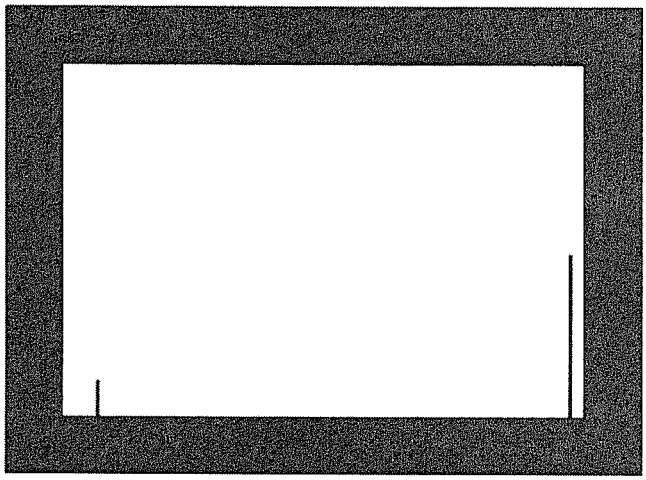

The disclosed system, method, and computer readable medium with instruction to cause movement of fluid within printhead channels prevents or discourages pigment precipitation and sedimentation formation in printhead channels orifices as well as ink drying out on the nozzle plate and around the nozzles, FIG. 10 is an example of the same white pattern 100 of FIGS. 1-4 printed on black background 104 after 240 minutes of the printhead idle time. FIG. 11 is an example of the same white pattern 100 printed on a black background 104 after 480 minutes of printhead idle time. FIG. 8 does not show visible artifacts affecting image quality. FIG. 11 shows few visible artifacts The functions and operations described with respect to waveform initiator service 806 and controller 802 may be implemented as a computer-readable storage medium containing instructions executed by a processor (e.g., processor 820) and stored in a memory (e.g., memory 822). In a given implementation, processor 820 may represent multiple processors, and memory 822 may represent multiple memories. Processor 820 represents generally any instruction execution system, such as a computer/processor based system or an ASIC (Application Specific Integrated Circuit), a computer, or other system that can fetch or obtain instructions or logic stored in memory 822 and execute the instructions or logic contained therein. Memory 822 represents generally any memory configured to store program instructions and other data.

Figure 12:
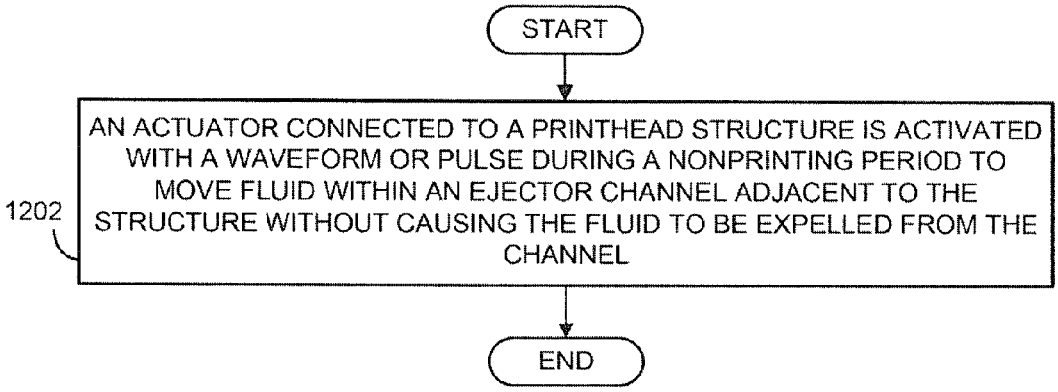
FIG. 12 is a flow diagram depicting steps taken to implement various embodiments.

FIG. 12 is a flow diagram of operation in a system according to various embodiments. In discussing FIG. 12, reference may be made to the diagrams of FIGS. 7 and 8 to provide contextual examples. Implementation, however, is not limited to those examples. Starting with FIG. 12, an actuator connected to a printhead structure is actuated with a waveform or pulse during a nonprinting period to pulse the structure to move fluid within an ejector channel adjacent to the structure without causing the fluid to be expelled from the channel (block 1202). Referring back to FIGS. 7 and 8, pulse module 708, or first pulse module 808 may be responsible for implementing block 1202.

Various modifications may be made to the disclosed embodiments and implementations without departing from their scope. Therefore, the illustrations and examples herein should be construed in an illustrative, and not a restrictive, sense.

What is claimed is:

1. A computer-readable storage medium containing instructions, the instructions when executed by a processor to cause the processor to:

activate an actuator connected to a printhead structure with a waveform to cause vibration of the structure sufficient to discourage particle precipitation and sedimentation in a fluid prone to precipitation or sedimentation to move the fluid within a printhead channel adjacent to the structure and not cause the fluid to eject from the channel onto a substrate during a nonprinting period of substrate loading or unloading.

2. The medium of claim 1, wherein the actuator is piezoelectric.

3. The medium of claim 1, wherein the fluid includes pigment particles.

4. The medium of claim 1, wherein the activation of the actuator with the waveform is at a substantially same voltage and a substantially same frequency as are used when the actuator is activated to expel fluid from the channel during a printing operation, and for a first duration that is less than a second duration that the actuator is activated during the printing operation.

5. The medium of claim 4, wherein the first duration is between substantially thirty percent and thirty-five percent of the second duration.

6. The medium of claim 1, wherein the activation of the actuator with the waveform is at a first voltage that is less than a second voltage used when the actuator is used to expel fluid from the channel during a printing operation, at a first frequency that is less than a second frequency used when the actuator is used to expel fluid from the channel during the printing operation, and for a first duration that is less than a second duration that the actuator is activated during the printing operation.

7. The medium of claim 6, wherein the first voltage is between substantially twenty-five percent and thirty-three percent of the second voltage.

8. The medium of claim 6, wherein the first frequency is between substantially ten percent and twelve percent of the second frequency.

9. The medium of claim 6, wherein the first duration is between substantially thirty percent and thirty-five percent of the second duration.

10. The medium of claim 1, wherein the nonprinting period includes a printhead deceleration period.

11. A system, comprising:

a first pulse module, to apply a first pulse at a printhead actuator at a first combination of voltage, duration, and frequency to cause shaking of printhead structure sufficient to discourage particle precipitation and sedimentation in a fluid prone to precipitation or sedimentation to move the fluid within a printhead channel adjacent to the structure without ejecting the fluid onto a substrate from the channel during a nonprinting period of substrate loading or unloading.

12. The system of claim 11, wherein the actuator is piezoelectric.

13. The system of claim 11, further comprising:

a second pulse module, to apply a second pulse at the actuator at a second combination of voltage, duration, and frequency to cause ejection of fluid from the channel during a printing period.

14. A method, comprising:

providing a substrate to a position for loading and unloading; and activating an actuator connected to a printhead structure during a non-ejection printing period of loading or unloading the substrate, to pulse the structure sufficient to discourage particle precipitation or sedimentation in a fluid prone to precipitation or sedimentation to move the fluid within an ejector channel adjacent to the structure without causing the fluid to be expelled from the channel.

15. The method of claim 14, wherein the fluid includes white pigment particles.

* * * * *